United States Patent [19]

Franz et al.

[11] Patent Number: 4,665,653

[45] Date of Patent: May 19, 1987

[54] SHIP'S DOOR OR HATCH ARRANGEMENT

[75] Inventors: Hans-Joachim Franz, Kölln-Reisiek; Jürgen Hommola, Hamburg; Bernd Langensiepen, Hamburg; Wolfgang Eckhardt, Hamburg, all of Fed. Rep. of Germany

[73] Assignee: Blohm & Voss AG, Hamburg, Fed. Rep. of Germany

[21] Appl. No.: 755,176

[22] Filed: Jul. 15, 1985

[30] Foreign Application Priority Data

Jul. 13, 1984 [DE] Fed. Rep. of Germany ..... 3425890

[51] Int. Cl.[4] ..... E06B 7/16

[52] U.S. Cl. ..... 49/477; 114/201 A; 220/232

[58] Field of Search ..... 49/477, 484; 220/232; 114/201 A

[56] References Cited

U.S. PATENT DOCUMENTS

| | | | |
|---|---|---|---|
| 1,806,859 | 5/1931 | Mattei | 49/477 |
| 2,551,750 | 5/1951 | Liskey | 220/232 |
| 3,180,302 | 4/1965 | Hamilton | 114/201 A |
| 3,284,955 | 11/1966 | Schroth | 49/477 |
| 3,819,479 | 6/1974 | Jacquelin | 49/484 |
| 3,857,199 | 12/1974 | Frach et al. | 49/477 |

FOREIGN PATENT DOCUMENTS

| | | | |
|---|---|---|---|
| 1310766 | 10/1962 | France | 49/484 |
| 0143749 | 9/1980 | German Democratic Rep. | 114/201 A |
| 729980 | 5/1955 | United Kingdom . | |

*Primary Examiner*—Kenneth J. Dorner
*Assistant Examiner*—Gerald A. Anderson
*Attorney, Agent, or Firm*—Nils H. Ljungman

[57] ABSTRACT

The invention concerns a ship's door or ship's frame arrangement which is provided with a door frame and a removable door leaf mounted in it. Peripherally mounted on one of the mutually facing peripheral edges of the frame and the door leaf and serving as a dynamic seal is an elastic tube which is connected to a pressure medium source and which, when pressurized, presses between the peripheral edges of the frame and the door leaf, thereby forming a seal between them and, when depressurized, lifts away from the opposite peripheral edges to form an annular clearance. In addition to the dynamic seal, a peripheral static seal is provided which serves as a spray-guard.

27 Claims, 13 Drawing Figures

SHIP'S DOOR OR HATCH ARRANGEMENT

BACKGROUND OF THE INVENTION

1. Field of the Invention

The invention relates generally to a ship's door or hatch arrangement with a frame and a door leaf and, more particularly, to a door which can be mechanically locked to the frame in which it is removably mounted.

2. Description of the Prior Art

Already known are watertight doors and hatches which are provided with a locking mechanism such as separate sash locks as well as sash locks which are actuated centrally by means of levers or handwheels. The seals and the closing and opening arrangements for such doors and hatches must be so designed that, with each closing, a planned watertight state is reached even for the most difficult conditions. This gives rise to a whole series of drawbacks in the manufacture, assembly and use, such as, for example, a very large number of expensive mechanical elements, great weight, the requirement for short maintenance intervals, awkward manipulation, high manufacturing, assembling and incidental costs, as well as the requirement for the separate operation of each door or hatch without the possibility of remote control. These requirements and disadvantages are a high price to have to pay for typical prior art systems.

With standard doors and windows, or with doors for autoclaves, it is already known from German Laid Open Patent Application Nos. DE-OS 22 30 132, DE-OS 15 09 709, and DE-OS 15 09 716, to arrange, between the peripheral edge of the door and the frame, an elastic tube which can be so pressurized by connecting it to a pressure medium source that the gap between the inner periphery of the frame and the door leaf is bridged-over and thus provides a peripheral seal between the door and the frame. With one of these known solutions (DE-OS 15 09 716), this type of seal has already been used in addition to the mechanical locking of the door. The use of this known sealing principle for ship's doors and hatches would, as is the case with previously known mechanical sealing systems, make it necessary for the pressure seal to be pressure-relieved or pressurized again with each opening and closing operation. This is particularly disadvantageous with doors which must be very frequently opened and closed because, in such cases, the dynamic seals which must be preferably pnuematically or possibly hydraulically actuated are subjected to frequent stressing, quite apart from the not-inappreciable consumption of energy and waste of the time needed in pressurizing and depressurizing the seals.

OBJECTS OF THE INVENTION

Thus, an objective of the invention is to create a ship's door or hatch arrangement of the above-mentioned type with a pressure loaded dynamic seal whereby, in the normal case, the dynamic seal is inactive and in no way hinders the opening or the closing of the door or hatch and hereby, with a closed door or hatch, there is, nevertheless, normal tightness against spray water.

It is another obJect of the invention, in the event of increased water pressure on the door or hatch, as occurs in heavy weather or in the case of water entering through a leak, to make it possible, in every case, to activate the dynamic seal.

It is a further object of the invention to provide a ship's door or hatch arrangement which is less expensive to manufacture, and cheaper to produce.

It is a yet further object of the invention to provide a door having lower weight.

It is a still further object of the invention to provide a door which is simpler to maintain.

It is a yet further object of the invention to provide a door which is more manageable to operate.

It is another yet further object of the invention to provide a door which is easier to control remotely.

SUMMARY OF THE INVENTION

In order to accomplish these objects, the invention provides that, in addition to the dynamic seal, there is provided a peripheral static seal. This arrangement with the dynamic and the static seal is such that only in the event of the expected increase in water pressure is the dynamic seal set against the door leaf at such a high pressure that the water is substantially sealed out even in heavy seas. The dynamic seal which lies between and joins the peripheral edge of the door produces, in the direction perpendicular to the force of water against the door, a force and/or a form closing action, preventing the door leaf from opening and simultaneously wholly or partially ensuring the sealing action. The sealing may be effectuated by an interlocking of appropriate elements.

Thus, in accordance with the invention, a division of functions is effected between two seals whereby, under normal conditions, there is produced with every closing operation a sealing action with respect to spray water. This sealing action can also prevent the penetration of a gas such a gasoline or other fumes. On the other hand, the dynamic seal which also checks the ingress of pressure water is only activated in the event of danger of water leakage. The spray watertight state is generally produced by a simple lip seal and single sash lock, while the pressure-water state is attained by inflating a pneumatic seal by the press of a button. Thus, the user can operate the door or the hatch in both the operating states in an optimally matched manner.

Advantageously, the static seal is located on the weather side of the dynamic seal, so that, in the unenergized state, the dynamic seal is protected from spray water.

An especially economical solution resides in making the static seal in one piece with the dynamic seal.

In accordance with an advantageous embodiment of the invention, the tube of the dynamic seal is accommodated in a peripheral groove. This embodiment acts together with an arrangement in which the inner periphery of the door frame is provided with a peripheral locking recess, which acts together with the tube. The expansion of the tube produced by the applied pressure thereto gives rise to an interlocking action between the door and the frame which is especially effective.

A first embodiment which does not require any special pressure supply lines provides each dynamic seal with its own hand operated pressure medium source. By this means, the pressure medium source can be made to apply its pressure by means of a hand operated lever. Furthermore, with this embodiment, it is advantageous when, in the pressurized state, the hand operated pressurization lever is swung so close to the standard door handle that the door handle can no longer be manipulated.

In this way, the position of the hand operated lever can indicate to the user whether an additional locking due to pressurizing the tube has been brought about or not. In addition, the hand operated pressurization lever will prevent the door handle from being manipulated when the supplementary locking action is activated by the dynamic seal.

However, preference is given to a second embodiment in which all the dynamic seals are connected to a central pressure medium source and all dynamic seals can be simultaneously pressurized via a central remote control. In the event of a leak or heavy weather, it is possible, from the command bridge, to effect a tight closing of all the latches and doors fitted with the systems of the invention.

It is advantageous when a manually operated valve is connected to each dynamic seal, which valve can also be activated by remote control. By this means, a specific door or hatch can be opened individually by hand at any time, which is of extreme importance, for example, when it is necessary for personnel to escape from a particular area of the ship or when a door must be opened to permit passage therethrough, even during heavy seas.

Also, in the event of a failure of the central compressed air source, to ensure that the dynamic seals can be actuated, a further embodiment of the invention assigns each hand operated valve or pump, if required via a pressure-reducing valve to a pressure reservoir which is connected to the pressure medium source via a non-return valve.

A preferred embodiment of the invention is characterized by the door leaf being provided with a profiled border which is bent and welded from a single piece. The border, which is in alignment with the surface of the door leaf is provided with a projecting seating on its periphery for accommodating the static seal. The seating faces in a direction at right angles to a perpendicular to the opening in the frame and the plane of the ship therearound. In this case, provision is especially made for the projecting seating to have a peripheral recess which faces in the direction perpendicular to the opening of the frame, with a lip seal being housed in the recess and extending as far as the frame.

In order ro obtain a stable yet light form of the design of the construction of the door, the invention additionally envisages that the profiled frame is bound into a solid constructional unit which includes cross struts located at different heights. Hinged joints and sash lock inserts are also provided. The remaining space, such as voids in the door leaf, are filled with insulating material. The door arrangement is such that cover plates are mounted on both sides of the solid constructional unit.

Further, for economy in production and also to achieve a compact and stable arrangement, it is advantageous for the frame to include grooved profile frame with an inward-facing open groove for receiving the elastic tube and an outwardly projecting mounting flange for attachment to a structure which constitutes a rigid part of the ship.

In order to make do with a relatively small number of screw or bolt connections, a further development of the invention is such that at its end, facing away from the groove, the mounting flange is provided with a peripheral sealing lip. The mounting flange is bolted to the structure between the sealing lip and the groove.

The dynamic seal in the preferred embodiment, in accordance with the invention, when pressurized, has to bridge an especially large distance. In order to accomplish this requirement, the tube in this embodiment has two side walls folded as in a concertina when in the unpressurized state. These two side walls become stretched when the said tube is in the pressurized state.

In view of the requirement to easily feed the pressure medium into the dynamic seal, it is advantageous for the dynamic seal to be housed in the frame, and is so housed in an embodiment of the invention. However, because this arrangement can be damaged or fouled relatively easily, another embodiment of the invention is provided in which the dynamic seal is housed in the door leaf and the supply of pressure medium is effected via a movable pressure transmitting device from the frame to the door leaf. In this case, the pressure transmitting device is preferably housed in one of the hinged joints of the door assembly.

BRIEF DESCRIPTION OF THE DRAWINGS

The invention will now be described, by way of example, on the basis of the appended drawings in which.

Figure 1:
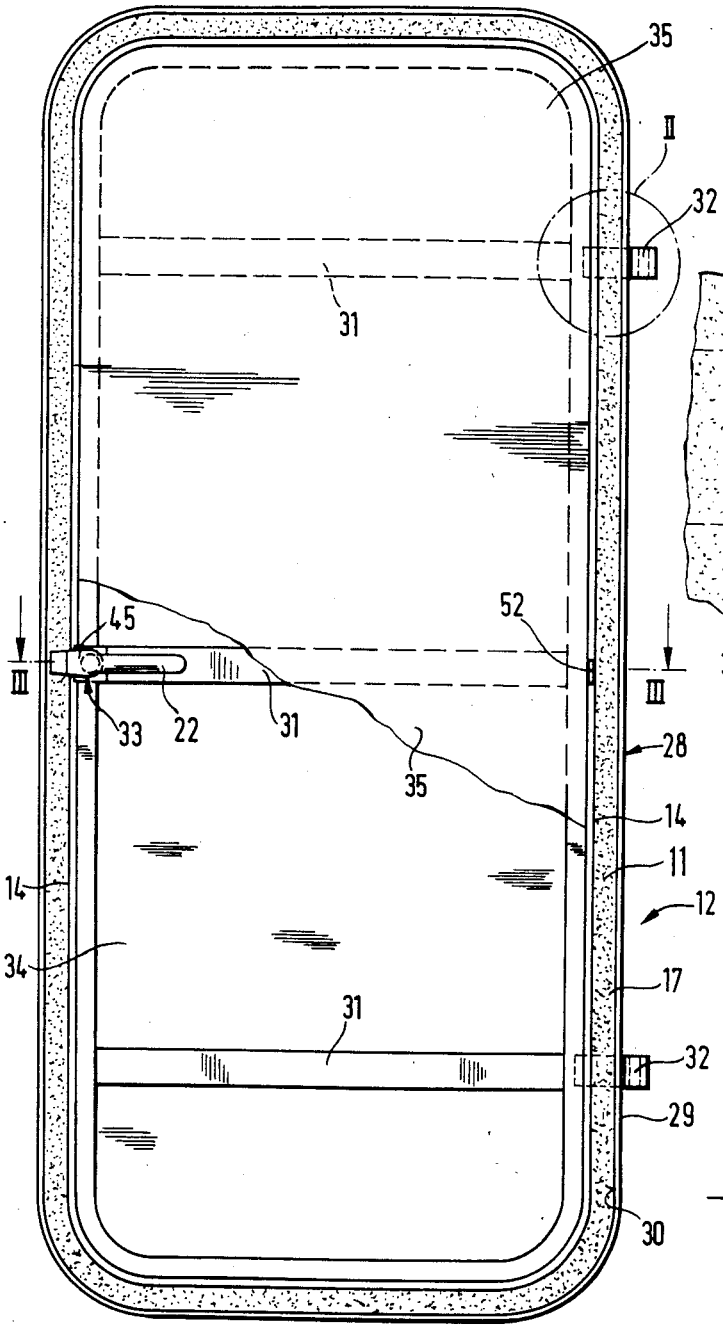
FIG. 1 shows schematically a front view of the door leaf of a ship's door arrangement in accordance with the invention.

FIG. shows, on an enlarged scale, a detail II of FIG. 1.

Figures 3, 4, 5:
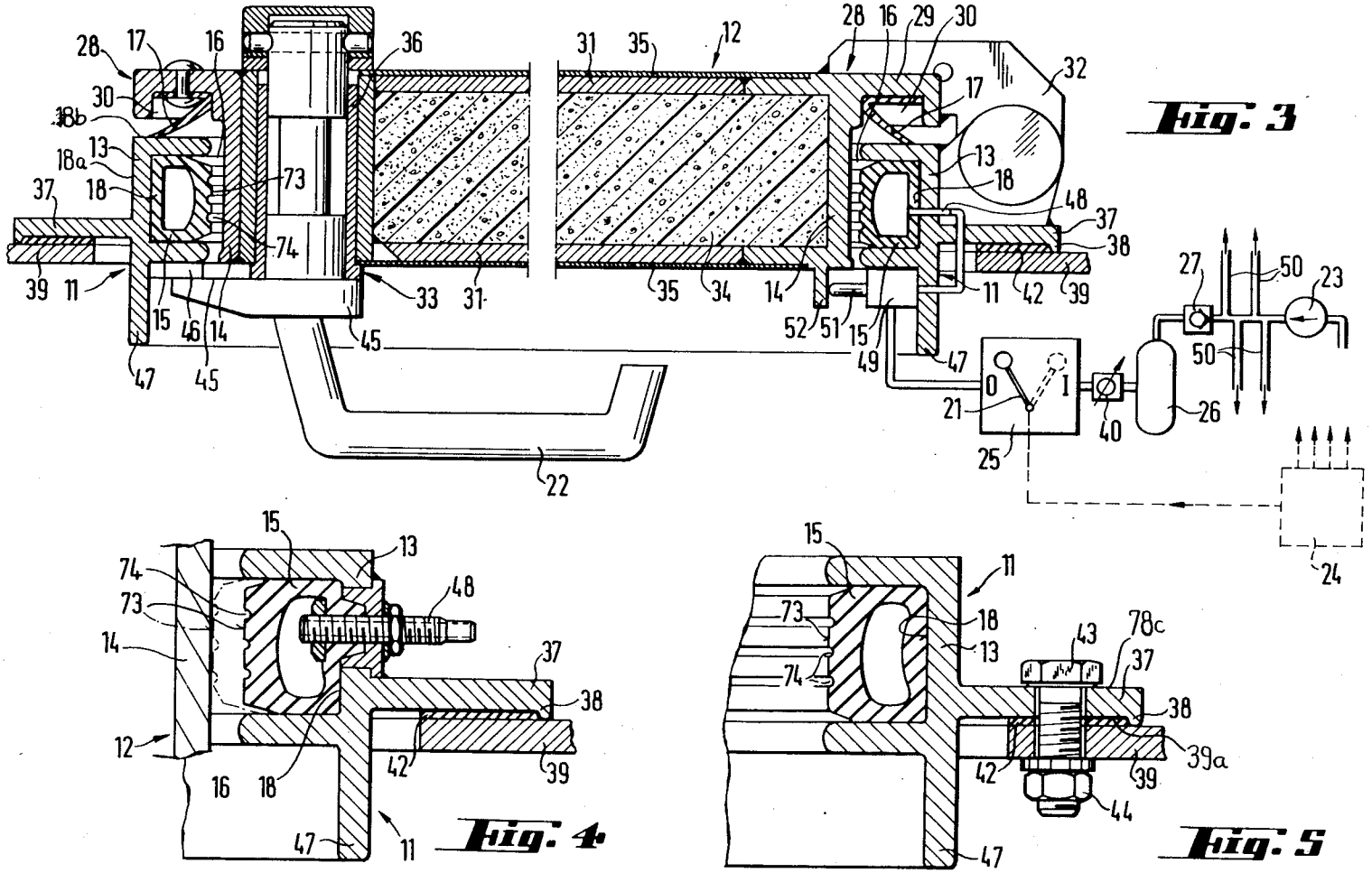

FIG. 3 shows, on an enlarged scale, a cross-section of the door shown in FIG. 1 taken along the line III—III, and also shows the frame surrounding the door leaf.

FIG. 4 shows a section of the frame of the ship's door arrangement illustrated in FIGS. 1 and 3 in the region of the connection to the pressure medium source.

FIG. 5 shows on a somewhat enlarged scale a section of the door frame shown in FIG. 3, to illustrate the screw attachment to the ship's structure.

Figure 6:
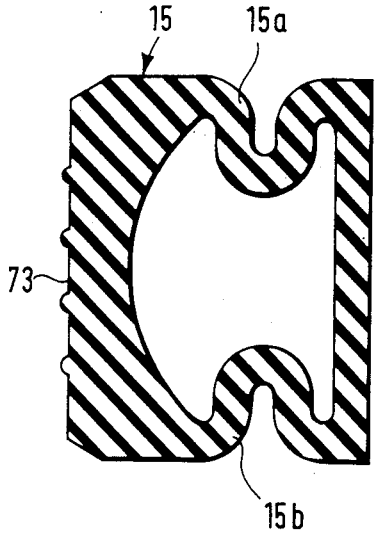

FIG. 6 shows schematically a cross-section of an elastic tube which is especially suitable for a ship's door or hatch arrangement in accordance with the invention, the tube being shown in its pressure-relieved state.

Figure 7:
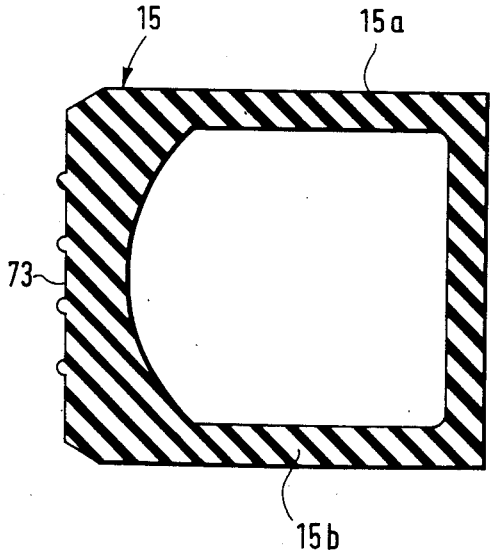

FIG. 7 shows a cross-sectional view of the same tube as in FIG. 6, but in the pressurized state.

Figure 8:
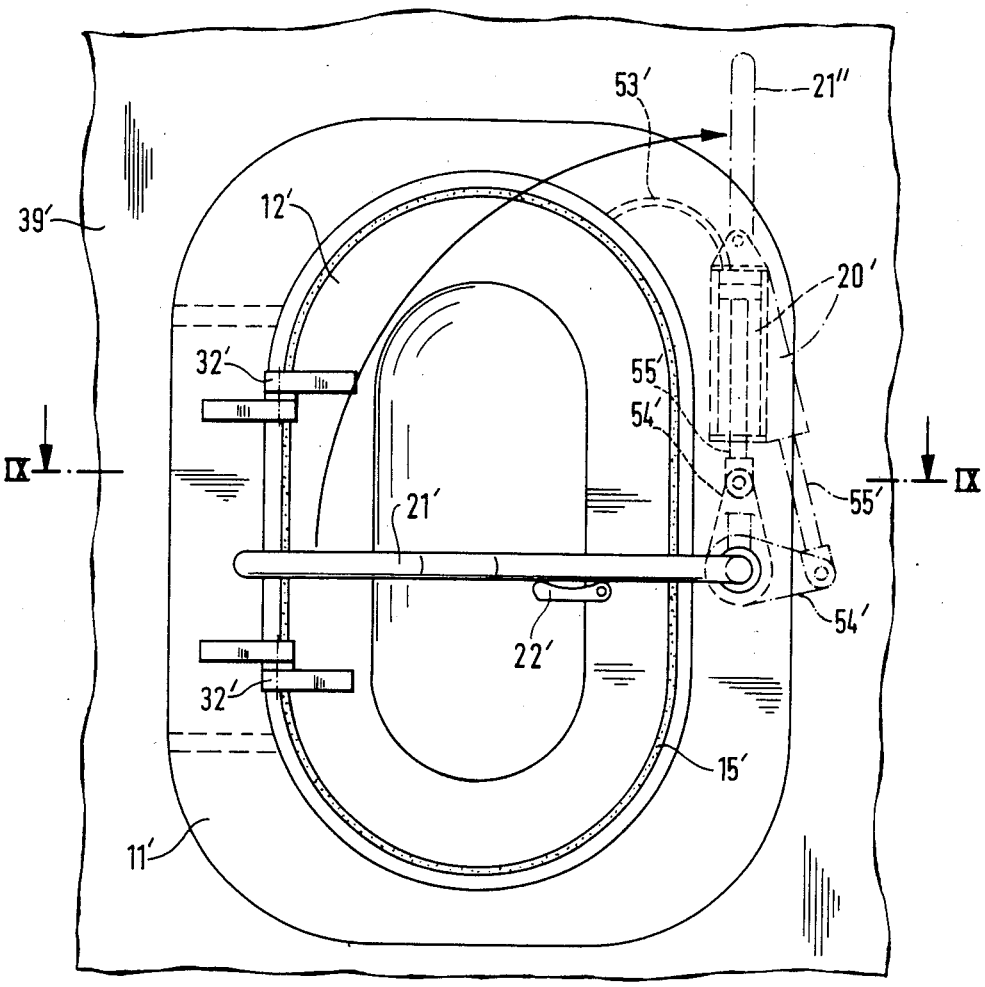

FIG. 8 presents a front view of a ship's door arrangement which is in accordance with the invention, with individual manual actuation of the dynamic seal.

Figure 9:
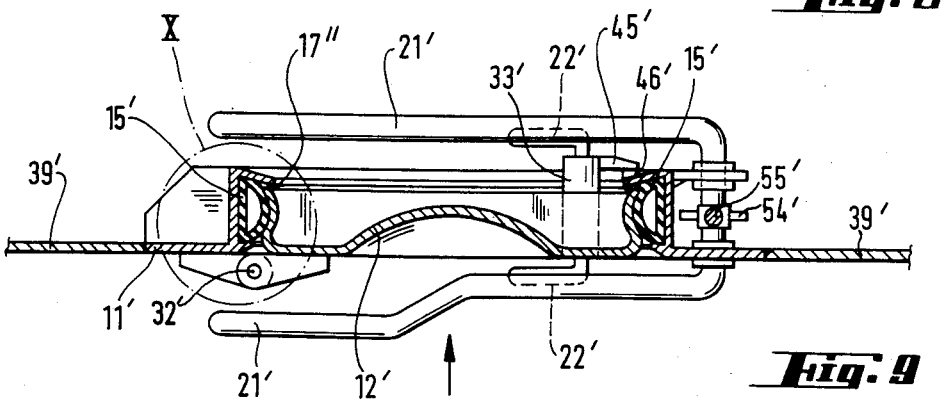

FIG. 9 presents a cross-sectional view taken along the line IX—IX of FIG. 8.

Figure 10:
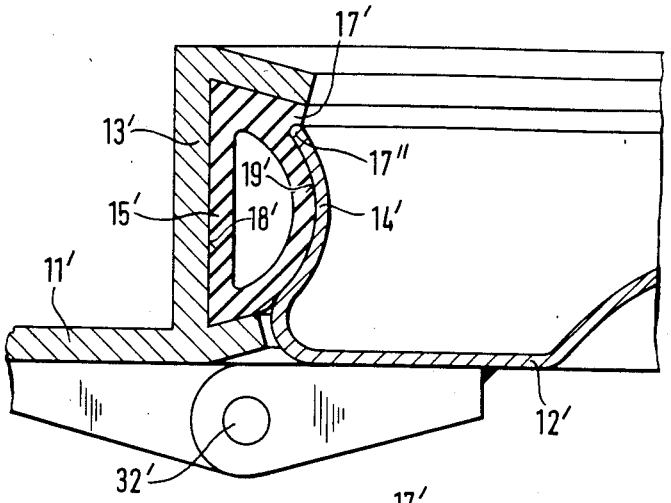

FIG. 10 shows, on an enlarged scale, the section X of FIG. 9 contained in the region within the dot-dash line.

Figure 11:
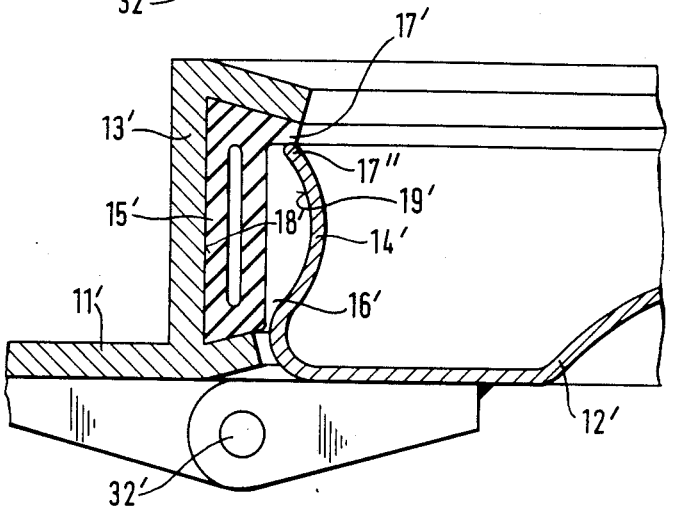

FIG. 11 shows the same view as in FIG. 10, but with the dynamic seal in its pressure-relieved state.

Figure 12:
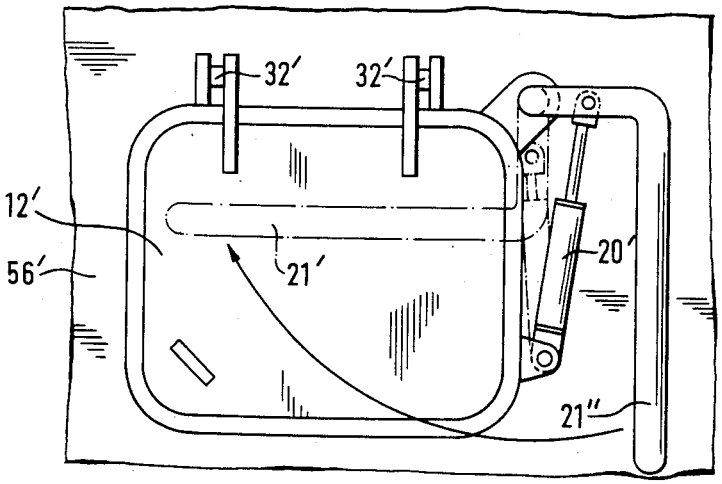

FIG. 12 shows schematically a plane view of a ship's hatch arrangement in accordance with the invention.

Figure 13:
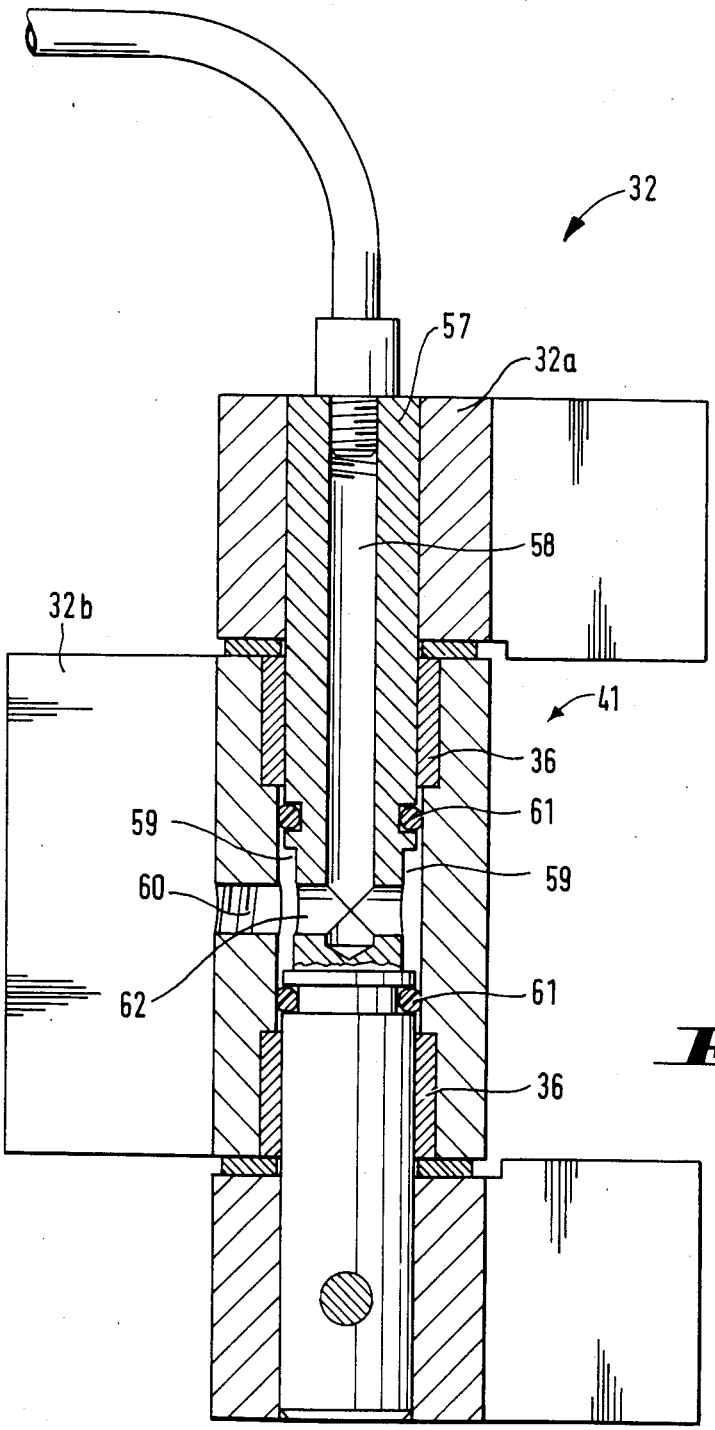

FIG. 13 presents schematically a side view of a hinged joint which incorporates a pressure medium transmitting device, the hinged joint belonging to a ship's door or hatch arrangement in accordance with the invention.

DESCRIPTION OF THE PREFERRED EMBODIMENTS

FIGS. 1 and 3 illustrate a door leaf 12 which essentially takes the form of a vertical rectangle with rounded edges and which forms part of a ship's door arrangement in accordance with the invention. The door leaf 12 is mounted on a frame 11 (shown in FIG. 3) by means of two hinged joints 32 arranged some distance apart, and arranged preferable one above the other. As shown in FIG. 3, the frame 11 comprises a grooved profile 18*a* which runs around the door opening and whose open groove 18 faces inwards towards the edge of the door leaf 12. The frame 11 is also provided with an outward extending mounting flange 37. As shown in FIGS. 3 and 5, in its edge away from the groove 18, the mounting flange 37 is provided with a peripheral sealing lip 38. In the overlap region between the flange 37 and a ship's hull 39, which is typically close to the door opening, sealing material 39*a* is held between the flange 37 and the ship's hull 39. In the manner shown in FIG. 5, the flange 37 is attached to the hull 39 by bolts 43 and nuts 44 at specific intervals around the door opening. The arrangement is such that the sealing lip 38 is pressed against the face of the hull 39. By this means, a front surface 78*c* made up by the grooved profile 18*a* can be attached with relatively few bolts 43.

Housed within the groove 18 is an elastic tube 15. The tube 15 matches the profile of the groove 18 which groove 18, in the present embodiment, is rectangular. The surface 73 of the tube 15 facing the door leaf 12 is typically flat and is, if need be, provided with notches 74 which increase the friction between the surface 73 and the door leaf 12. The elastic tube 15 typically extends completely around the inner peripheral edge 13 of the frame 11 facing the door leaf 12.

As shown in FIG. 3, abutting against the upper arm of the groove 18 is a peripheral lip seal 17 while, on the opposite or lower arm, a locking stop 46 is attached at the level of a sash-bolt 45. In this region, the door frame 11 is extended and thereby reinforced by a wall piece 47 which extends in the direction away from the lip seal 17 along the inner peripheral edge 13.

The peripheral edge 14 of the door leaf 12 faces the flat face 73 of the tube 15, leaving a well-defined annular clearance 16. The peripheral edge 14 is formed by a profile frame 28 which is extended outwards from a face of the peripheral edge 14 and is turned away from the frame by a projecting seating 29, thereby providing a peripheral recess 30 which faces, at a distance, a neighboring arm 18*b* of the groove profile 18*a*. The lip seal 17 is accommodated in the peripheral recess 30 in such a way that, when the door leaf 12 is in the closed position, as shown in FIG. 3, it presses against the associated arm of the grooved profile 18*a* to form a tight seal.

As shown in FIGS. 1 and 3, cross-struts 31 are welded in or bolted on the profiled frame 28 at vertical intervals which profiled frame 28 is bent out of one piece and the ends thereof welded together. In addition, the hinged joints 32 and the sash bolt 33 are welded or bolted to the profiled frame 28.

The voids remaining in this sturdy constructional unit are filled with insulating material 34, preferably polyurethane, and more preferably foam, which is held in the space within the door leaf 12 by the stuck-on cover plates 35.

Figure 2:
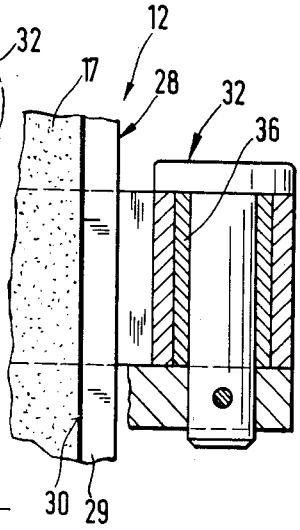

As shown in FIG. 2, the hinged joints 32 are provided with self-lubricating sleeves 36 which can also be incorporated in the sash bolt unit.

According to FIGS. 3 and 4, the interior of the elastic tube 15 is preferably pneumatically connected via a pressure-medium connector 48 and a safety valve 49, as shown in FIG. 3, to a magnetically operated valve 25. The magnetically operated valve 25 is fitted with a manually operated level 21 which can also be actuated by a central command via a pressure reducing valve 40 to a pressure reservoir 26 which reservoir 26 is acted upon in turn, via a non-return valve 27 by a central pressure-medium source 23. Via additional pneumatic pipe-lines 50, the central pressure-medium source 23 typically feeds a series of similar dynamic seals 15 on the other door or hatch systems of the same ship.

The mode of operation of the above-described ship's door arrangement is as follows:

Normally, the hand operated lever 21, associated with the magnetic valve 25, is in the closed position indicated by the solid lines in FIG. 3, in which case the pressure in the pressure reservoir 26 is cut off from the elastic tube 15. As a result, the elastic tube 15 is now in a pressure-relieved state as indicated in FIGS. 3 to 5, so that, as shown in FIG. 3, a well-defined annular clearance 16 is to be found between the tube 15 and the peripheral edge 14 of the door leaf 12. With the door leaf 12 closed, the seal between the door leaf 12 and the frame 11 is now assured solely by the spray-water checking lip seal 17.

As shown in FIG. 3, when the door leaf 12 is closed, the hand operated lever 21 is turned into the open position I of the valve 25, as shown by the dotted lines. The pressure in the pressure reservoir 26 is applied via the pressure-reducing valve 40, the magnetic valve 25, the safety valve 49 and the connector 48 to the interior of the tube 15, whereby the tube 15 is inflated to the position indicated by the broken lines in FIG. 4. The flat side 73 of the tube 15 now applies itself under pressure against the peripheral edge 14 of the door leaf 12 and thus contributes to an additional sealing and locking action. However, this position of the tube 15 is only utilized in heavy weather or in the case of an emergency as, for example, when, as a result of a leak in the ship, water from the inside presses against the door leaf 12.

Actuation of the magnetic valve 25 can also be effected by the remote control unit 24 which also acts upon the additional door and hatch systems (not shown).

The safety valve 49 is connected via a pin 51 with a stop 52 projecting from the door leaf 12 in such a way that, when the door leaf 12 is in its closed position as shown in FIG. 3, the safety valve 49 is open and thus the pressure from the magnetic valve 25 is permitted to pass to the tube 15.

With this configuration, it is very difficult and almost impossible to open the door leaf 12. If the pressure in the tube 15 is allowed to drop by moving the hand operated lever 21 into the position O, the door leaf 12 can then be opened in the usual way after manipulating the sash bolt 45, as a result of which the lip seal 17 lifts away from the frame 11. At the same time, the stop 52 releases itself from the pin 51 of the safety valve 49, as a result of which, due to the action of an incorporated biasing member such as a spring (not shown), the safety valve 49 is moved over into its closed position. If, at this stage, the magnetic valve 25 is actuated by the hand operated lever 21 or by the remote control 24, the pressure would not be passed on into the tube 15. Only when the door leaf 12 is closed again does the stop 52 strike the pin 51 and push it into the open position, as a result of which the safety valve 49 causes pressure to be passed on into the tube 15.

An especially advantageous profile for the elastic tube 15 is shown in FIGS. 6 and 7. In the depressurized state shown in FIG. 6, the side-walls 15*a* and 15*b* of the tube 15 are folded in a concertina-like manner. If the interior of the tube 15 is put under pressure, the sidewalls 15*a* and 15*b* assume the stretched position shown in FIG. 7, whereby the face 73 covers an especially large distance, the amount of which can be up to 50% of the total height of the tube 15.

An alternative embodiment of the invention is shown in FIGS. 8 to 11. A frame 11' is attached to a door leaf 12' by means of the hinged joints 32'. The frame 11' is mounted on the hull 39' of a ship. On the inner peripheral edge 13' of the frame 11', facing the door leaf 12', an elastic tube 15' is housed in the slot 18', as was the case in the previously described embodiment. As shown in FIGS. 9 and 11, one side of the said tube 15' carries a sealing lip 17' which acts in conjunction with an edge 17'' of the door leaf 12'.

The special feature of the embodiment shown in FIGS. 8 to 11 resides in the fact that the inner peripheral edge 14' of the door leaf 12' is provided with a ditch-like recess 19', as shown in FIG. 11, into which the tube 15' extends when pressurized, as shown in FIG. 10, so that, besides the frictional or force engagement, such as is solely effective in the embodiment shown in FIG. 3. This ditch-like recess 19' provides an additional interlocking action between the frame 11' and the door leaf 12'.

In the embodiment illustrated by FIGS. 8 to 11, the pressure in the tube 15' is preferably produced by a hand operated pressure medium source 20', which takes the form of a cylinder, the pressure chamber of which is connected via a pipe line 53' (as shown in FIG. 8) with the interior of the tube 15'. In FIG. 8, a toggle-lever mechanism 54' connects the piston rod 55' of the pressure medium source 20' with a hand operated rocking lever 21' which is rotatably pivoted close to the door leaf 12' on the side of the frame 11' away from the hinged joints 32'. When the rocking lever 21' is swung upwards into the vertical position 21'' (shown by the broken lines in FIG. 8), the piston in the pressure medium source 20' will be in its lower position. As a result the elastic tube 15' will be depressurized and will take up the rest position shown in FIG. 11, in which position the annular clearance is present between the tube 15' and the peripheral edge 14' of the door leaf 12'. In this state, the sealing edge 17'', which belongs to the door leaf 12' and which abuts the sealing lip 17', assumes the function of the spray water seal.

If now the hand operated lever 21' is swung downwards into the horizontal position shown by the solid lines in FIG. 8, the upward displacement of the piston of the pressure medium source causes the interior of the tube 15' to be put under pressure and, as a result, the inflowing hydraulic medium causes the tube 15' to assume the locking state, as may be seen from FIGS. 9 and 10. In accordance with the invention, the hand operated lever 21' lies on both sides of the door leaf 12', right across in front of the door leaf 12' which, at the same time, gives an indication that the tube or dynamic seal 15' is in the locked state. Because the hand operated lever 21' is, in this case, lying at the same time immediately over the door handle 22' (FIGS. 8 and 9), any undesired actuation of the door handle 22' is also automatically prevented.

It is preferable and sometimes essential that a hand operated lever 21' is provided on both sides of the door leaf 12'.

The door frame 11' along with all its attached constructional elements, including the door leaf 12', can be prefabricated and then installed as a prefabricated assembly unit in the previously provided door opening in the ship's hull 39' by welding or riveting.

The door leaf 12' is preferably pressed from a metal plate and, both with the shaped door edge and with the flange or channelure with the door bay, constitutes, without further reinforcement, dimensionally stable closure for the acting pressure loads, provided that the tube is pressurized. On depressurizing the tube, the door leaf is comparatively easy to handle as a normal traffic door.

The elastic tube seal 15', when pressurized and locked into the recess 19', is almost completely protected against all possible types of damage due to external dangers because of the particular way in which it is accommodated in the door frame 11', and in the closed door leaf 12'. This protection can, if required, be still further increased by guard plates or masks.

As shown in FIG. 12, the invention can also be employed with a hatch arrangement in which the door leaf 12' constitutes a hatch which can be swung up around the hinges 32'. In this case, the hand operated lever 21' can be swung round horizontally to bring it into the pressure position over the door leaf 12', as indicated by the broken lines in FIG. 12. Instead of being built into a ship's hull 39', as shown in FIG. 8, the ship's hatch arrangement shown in FIG. 12 is built into a ship's deck. The frame 11' and the door leaf 12', as well as the sealing and manipulating elements, are constructed analogously to those in the embodiment example illustrated in FIGS. 8 to 11.

The door leaf 12' which constitutes the frame cover is pressed from a single metal plate.

An especially protected accommodation for the elastic sealing tube 15' is possible in the door leaf 12'. In this case, of course, the preferably hydraulic or pneumatic pressure medium must be conveyed into the movable door leaf 12' by means of a pressure medium transfer unit 41'. As shown in FIG. 13, this can be effected through the spindle 57 of the hinge 32. Provided in the hinge part 32*a*, lying along the spindle 57 and mounted on the door frame is an axial hole 58 which, at the level of the pivot of the door leaf hinge part 32*b*, converts into the transverse hole 62 which opens into a sealed-off annular chamber 59 to which is branched a hydraulic or pneumatic hole 60 which leads to the door leaf 12'. Ring-seals 61, which seal off the annular chamber 59 from the outside, are provided in the hinge part 32*b*.

Referring again to FIG. 3, because the seals can move out laterally by a few millimeters when subjected to a high water pressure, the locking stop 46 can, in accordance with the invention, likewise be made to be elastically deflectable by a few millimeters in order that the sash lock 45, in association with the locking stop 46, does not receive the entire force and, as a result, with the absorption of the force, mutual support is ensured between the sash-fastener arrangement and the seal.

The invention as described hereinabove in the context of a preferred embodiment is not to be taken as limited to all of the provided details thereof, since modifications and variations thereof may be made without departing from the spirit and scope of the invention.

What is claimed is:

1. Arrangement for sealing, from intrusion of water, an opening on a ship for navigation in heavy seas having a door member, said arrangement comprising:

frame means for being disposed about a peripheral portion of said opening and for being attached to said ship, said frame means defining a plane;

means for permitting movement of said door member away from said frame means at least initially, substantially, perpendicularly from said plane of said frame means;

said door member for fitting within said frame means and for opening to allow passage through said frame means and for closing to prevent passage through said frame means, said door member and said frame means having a space therebetween;

a first sealing means for sealing substantially statically said space between said door member and said frame means when said door member is closed against intrusion of water within a first predetermined pressure range;

a second sealing means having a portion for sealing substantially dynamically said space between said frame means and said door member when said door member is closed against said intrusion of water; said substantially dynamic, second sealing means having means for dynamically extending said portion to seal said space between said frame means and said door member and holding said door member tightly within said frame means to withstand said intrusion of water and substantially prevent leakage of water within a second predetermined pressure range including pressures produced by heavy seas and for dynamically retracting said portion; said second predetermined pressure range having at least a portion thereof greater than a maximum portion of said first predetermined pressure range; said means for dynamically extending and retracting having means for extending and retracting when acted upon by a fluid pressure medium;

said first, static, sealing means being independent of and sealing independently of said second, dynamic, sealing means;

said first, static, seal means being disposed between said frame means and said door member to protect said second, dynamic, seal means from spray water at least when said second, dynamic, seal means is retracted and not extended;

said door member having door handle means for assisting in opening and closing of said door member, said door member and frame means having latching means for latching said door member in said frame means and for preventing said door member from opening when latched; and said means for extending and for retracting said portion of said substantially dynamic, second sealing means for sealing said space between said frame means and said door member for connection to means for selectively controlling said extending and retracting means, said means for selectively controlling said extending and retracting means having means for actuating being separate from said door handle means and said latching means, said means for selectively controlling being for independently and optionally actuating said second, dynamic, sealing means, whereby water in said second predetermined pressure range, including water from pressures produced by heavy seas, is substantially sealed out and said intrusion of water is minimized.

2. The arrangement for sealing an opening on a ship according to claim 1 wherein said substantially static, first sealing means is a spray guard, and said first predetermined pressure range includes a range of pressure of spray.

3. The arrangement for sealing an opening on a ship according to claim 1 wherein said substantially dynamic, second sealing means includes interlocking means having edge means for providing interlocking between said frame means and said door member, said interlocking means for fitting within said frame means, whereby said intrusion of water in said second predetermined pressure range is minimized.

4. The arrangement for sealing an opening on a ship according to claim 1 wherein said frame means and said door member each have edges facing one another when said door member is closed within said frame means, said narrow edges defining said space between said door member and said frame means; said substantially dynamic, second sealing means being disposed in said space between said frame means and said door member.

5. The arrangement for sealing an opening on a ship according to claim 4 wherein said substantially static, first sealing means comprises a static seal which is a peripherally mounted lip , seal.

6. The arrangement for sealing an opening on a ship according to claim 1 wherein said substantially dynamic, second sealing means has a weather side and an inships side; said substantially static, first sealing means being disposed on said weather side of said substantially dynamic, second sealing means.

7. The arrangement for sealing an opening on a ship according to claim 1 wherein said substantially static, first sealing means and said substantially dynamic, second sealing means comprise one unitary piece including both said sealing means.

8. The arrangement for sealing an opening on a ship according to claim 4 wherein said substantially dynamic, second sealing means comprises a tube and a peripheral groove for receiving said tube.

9. The arrangement for sealing an opening on a ship according to claim 8 wherein said tube is disposed against a first one of said edges in operation, and said groove being disposed in the other one of said edges.

10. The arrangement for sealing an opening on a ship according to claim 1 comprising a plurality of said arrangements, each said arrangement having a separate manually operable source of a pressure medium for energizing and extending its corresponding substantially dynamic, second sealing means.

11. The arrangement for sealing an opening on a ship according to claim 10 wherein said pressure medium source has a manually operable lever means for controlling flow of said pressure medium.

12. The arrangement for sealing an opening on a ship according to claim 11 wherein said manually operable lever means has a manually operable lever, said level being disposed to swing in front of said door member when closed to prevent opening of said door member when said lever is thereinfront.

13. The arrangement for sealing an opening on a ship according to claim 12 wherein said door member has door handle means for assisting in opening and closing of said door member, said manually operable lever for being disposed, when said substantially dynamic, second sealing means is extended, to swing so close to said door handle means that said door handle means is blocked by said manually operable lever and said door handle means can no longer open said door member.

14. The arrangement for sealing an opening on a ship according to claim 2 including a plurality of sealing arrangements each having an associated one of said substantially dynamic, second sealing means;

a central source of said fluid pressure medium;

central remote control means for regulating flow of said fluid pressure medium for said central source, wherein all said plurality of substantially dynamic, second sealing means for sealing out said high seas are connected to said central pressure medium source, and wherein all said substantially dynamic, second sealing means can be simultaneously pressurized from said central remote control means.

15. The arrangement for sealing an opening on a ship according to claim 14 including a plurality of manually operable valves for connection to its corresponding substantially dynamic, second sealing means for at least selectively retracting said means for retracting of said substantially dynamic, second sealing means.

16. The arrangement for sealing an opening on a ship according to claim 15 wherein said plurality of manually operable valves are connected to and operable by said central remote control means for selectively extending and retracting said means for extending and for retracting of said substantially dynamic, second sealing means.

17. The arrangement for sealing an opening on a ship according to claim 15 wherein each said manually operated valves are connected to a pressure reservoir by means of pressure reducing valve means, said pressure reservoir being connected through a non-return valve to said pressure medium source.

18. The arrangement for sealing an opening in a ship according to claim 4 wherein said door member has a profiled border being bent and welded from a single piece, said profiled border being aligned with said edge of said door member, said profiled border having a projecting seating at its periphery;

said projecting seating projecting, when said door member is closed, toward the outerside of said ship;

said border for receiving said substantially static, first sealing means, said projecting seating having a portion; and said seating portion being disposed, when said door member is in its closed position, in a direction perpendicular to a plane defining said opening in said frame means.

19. The arrangement for sealing an opening in a ship according to claim 18 wherein said projecting seating comprises:

a peripheral recess, said peripheral recess opening toward said frame means when said door member is in said closed position; and a lip seal, said lip seal being disposed in said peripheral recess, and said lip seal extending and making contact with said frame means when said door is in said closed position.

20. The arrangement for sealing an opening in a ship according to claim 18 including cross struts connected to and holding said profiled border of said door member;

said cross struts being disposed at a plurality of heights on said door member;

said door member having hinges and mechanical door-locking means attached thereto;

said door member having an outboard facing side for facing said high seas, and an inboard facing side for facing an interior portion of said ship; said outboard facing side and said inboard facing side of said door member having covering plates thereon; and said door member having at least one void within said door member being filled with insulating material.

21. The arrangement for sealing an opening in a ship according to claim 20 wherein said hinges and said mechanical door-locking means have self lubricating liners.

22. The arrangement for sealing an opening in a ship according to claim 18 wherein said frame means comprises a grooved profile, said frame grooved profile having a groove;

said frame groove being disposed to face towards said edge of said door member when said door member is in its closed position;

said frame grooved profile having a mounting flange extending therefrom; and said frame mounting flange for rigid attachment to a portion of said ship around said opening.

23. The arrangement for sealing an opening in a ship according to claim 22 wherein said frame mounting flange has a peripheral sealing lip;

said frame mounting flange being disposed on said frame profile and extending therefrom opposite to a portion of said frame mounting flange which is adjacent to said groove;

said frame peripheral sealing lip being disposed on a portion of said frame mounting flange being opposite to a portion of said frame mounting flange which is adjacent to said groove;

said mounting flange having means for attachment to said ship; and said means for attachment to said ship being disposed between said sealing lip and said frame groove on said frame mounting flange.

24. The arrangement for sealing an opening in a ship according to claim 1 wherein said means for extending and for retracting said portion of said substantially, dynamic second sealing means comprises a tube having two sidewalls;

said sidewalls being folded in a shape of a concertina when said substantially dynamic, second sealing means is retracted; and said sidewalls becoming stretched and extended when said means for extending and retracting a portion of said substantially dynamic, second sealing means is extended.

25. The arrangement for sealing an opening in a ship according to claim 1 wherein said substantially dynamic, second sealing means is disposed in said frame means.

26. The arrangement for sealing an opening in a ship according to claim 1 wherein said substantially dynamic, second sealing means is disposed in said door member; and including means for transferring said fluid medium for extending said means for extending and retracting to said door member, said means for transferring said fluid medium having means for connection to a source of said medium.

27. The arrangement for sealing an opening in a ship according to claim 26 wherein said door member has hinged means for connecting said door member to said frame means; and said pressure transmitting means being disposed in said hinged means.

* * * * *